US008113445B2

(12) United States Patent
Drozd

(10) Patent No.: US 8,113,445 B2
(45) Date of Patent: Feb. 14, 2012

(54) SPRAY GUN HAVING AIR CAP WITH UNIQUE SPRAY SHAPING FEATURES

(75) Inventor: Mitchell M. Drozd, Harwood Heights, IL (US)

(73) Assignee: Illinois Tool Works Inc., Glenview, IL (US)

( * ) Notice: Subject to any disclaimer, the term of this patent is extended or adjusted under 35 U.S.C. 154(b) by 408 days.

(21) Appl. No.: 12/046,249

(22) Filed: Mar. 11, 2008

(65) Prior Publication Data

US 2009/0230218 A1 Sep. 17, 2009

(51) Int. Cl.
*B05B 1/28* (2006.01)

(52) U.S. Cl. ..... 239/292; 239/296; 239/291; 239/518; 239/DIG. 14

(58) Field of Classification Search ..... 239/292, 239/296, 291, 518
See application file for complete search history.

(56) References Cited

U.S. PATENT DOCUMENTS 2,070,696 A * 2/1937 Tracy ..... 239/8
2,303,280 A * 11/1942 Jenkins ..... 239/296
4,349,153 A * 9/1982 Johnson ..... 239/105
4,854,504 A * 8/1989 Hedger et al. ..... 239/294
5,074,466 A * 12/1991 Santiago ..... 239/8
5,344,078 A * 9/1994 Fritz et al. ..... 239/296

* cited by examiner

*Primary Examiner* — Dinh Nguyen
(74) *Attorney, Agent, or Firm* — Fletcher Yoder, PC

(57) ABSTRACT

A spray coating device, in one embodiment, is provided with a liquid passage, an air passage, one or more valves configured to open and close flow of liquid through the liquid passage and air through the air passage, a trigger coupled to the one or more valves, and a spray head configured to generate a non-conical liquid spray. The spray head includes a liquid exit in fluid communication with the liquid passage, wherein the liquid exit has a longitudinal axis of liquid flow, an air exit in fluid communication with the air passage, wherein the air exit is coaxial with the liquid exit, a first plurality of air shaping orifices in fluid communication with the air passage, wherein the first plurality of air shaping orifices have first axes that generally converge toward a first point along the longitudinal axis at first acute angles relative to the longitudinal axis, and a second plurality of air shaping orifices in fluid communication with the air passage, wherein the second plurality of air shaping orifices have second axes that generally converge toward a second point along the longitudinal axis at second acute angles relative to the longitudinal axis, the first and second acute angles are different from one another, and the first and second points are in series one after another along the longitudinal axis.

27 Claims, 8 Drawing Sheets

SPRAY GUN HAVING AIR CAP WITH UNIQUE SPRAY SHAPING FEATURES

FIELD OF INVENTION

The present invention relates generally to spray systems and, more particularly, to industrial spray coating systems for applying coatings of paint, stain, and the like. Specifically, the invention relates to an air cap having unique spray pattern shaping features for improving the atomization and spray pattern shape of a coating fluid.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Existing spray guns typically employ a process of liquid atomization which includes generating small liquid drops from a column or sheet of fluid dispensed from a fluid orifice. The process of atomization in typical two-phase flow conditions involves the potential energy of liquid flowing from a fluid nozzle at a high velocity as a fluid stream. When the fluid stream encounters a collinear air flow around the fluid column, it undergoes primary and secondary phases of atomization. The first phase is characterized as a solid stream near the fluid nozzle. During the secondary phase of flow, atomization takes place and fluid droplets are formed.

These fluid droplets may be shaped using shaping air flows into specific spray patterns which are generally conical shaped. As a result, the width and/or cross-section of the spray generally increases in a linear manner from an exit of the spray gun to a target surface being coated by the spray gun. In other words, the outer profile or periphery of the spray is generally characterized by an angle that is constant relative to a centerline of the spray gun. The spray velocity also decreases with distance away from the exit of the spray gun.

Thus, if the spray gun is positioned relatively close to the target surface, then the spray covers a relatively small coverage portion of the target surface at a relatively high velocity. Unfortunately, the small coverage portion can increase the time to complete a spray coating process and also reduce the uniformity in the spray coating. If the velocity of the spray is too high at this close distance, then the spray may not transfer efficiently to the target surface (i.e., poor transfer efficiency). For example, the high velocity may cause the spray to bounce off of the target surface, rather than adhering to it. As a result, the poor transfer efficiency creates more waste and pollution into the environment, while it also increases the cost for coating the target surface (i.e., a greater amount of fluid is needed to coat the surface).

If the spray gun is positioned further away from the target surface, then the spray covers a relatively larger coverage portion of the target surface at a relatively low velocity. Unfortunately, if the velocity is too low at this greater distance, then the spray may not transfer efficiently to the target surface (i.e., poor transfer efficiency). Again, the poor transfer efficiency creates more waste and pollution into the environment, while it also increases the cost for coating the target surface (i.e., a greater amount of fluid is needed to coat the surface).

As a result, a typical spray gun with a conical spray is positioned at a certain distance to ensure that the velocity is not too fast or too slow. Unfortunately, the distance may result in a small coverage area, which can decrease the uniformity in the spray coating and increase the requisite time to coat the target surface. In other words, an optimal velocity results in a less than optimal coverage area, and vice versa. The typical spray gun does not provide both an optimal velocity and an optimal coverage area due to the conical shape of the spray.

BRIEF DESCRIPTION

A spray coating device, in one embodiment, is provided with a liquid passage, an air passage, one or more valves configured to open and close flow of liquid through the liquid passage and air through the air passage, a trigger coupled to the one or more valves, and a spray head configured to generate a non-conical liquid spray. The spray head includes a liquid exit in fluid communication with the liquid passage, wherein the liquid exit has a longitudinal axis of liquid flow, an air exit in fluid communication with the air passage, wherein the air exit is coaxial with the liquid exit, a first plurality of air shaping orifices in fluid communication with the air passage, wherein the first plurality of air shaping orifices have first axes that generally converge toward a first point along the longitudinal axis at first acute angles relative to the longitudinal axis, and a second plurality of air shaping orifices in fluid communication with the air passage, wherein the second plurality of air shaping orifices have second axes that generally converge toward a second point along the longitudinal axis at second acute angles relative to the longitudinal axis, the first and second acute angles are different from one another, and the first and second points are in series one after another along the longitudinal axis. A spray shaping system, in another embodiment, is provided with a first plurality of air shaping orifices having first axes directed toward a longitudinal axis of a liquid stream at first acute angles relative to the longitudinal axis, and a second plurality of air shaping orifices having second axes directed toward the longitudinal axis of the liquid stream at second acute angles relative to the longitudinal axis, wherein the first and second axes cross one another prior to reaching the longitudinal axis, the first and second acute angles are different from one another, or a combination thereof. In yet another embodiment, a spray coating system is provided with an air cap including a central atomization orifice having a longitudinal axis, a first set of air shaping orifices disposed on opposite sides of the central atomization orifice, wherein the first set of air shaping orifices are directed toward a first point along the longitudinal axis, and a second set of air shaping orifices disposed on opposite sides of the central atomization orifice, wherein the second set of air shaping orifices are directed toward a second point along the longitudinal axis, and the first and second points are in series with one another. In a further embodiment, a method of spraying a coating fluid is provided including the step of directing air streams toward a liquid stream to create a non-conical spray of the coating fluid. A spray coating device, in yet another embodiment, is provided with a body comprising liquid and air passages, and a fluid delivery tip assembly coupled to the body. The fluid delivery tip assembly includes a liquid orifice configured to output a liquid stream, an air orifice configured to output a first air stream toward the liquid stream to generate an atomized liquid spray, and a plurality of air shaping orifices configured to output air shaping streams toward the atomized liquid spray to shape the atomized liquid spray into a cup shape.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
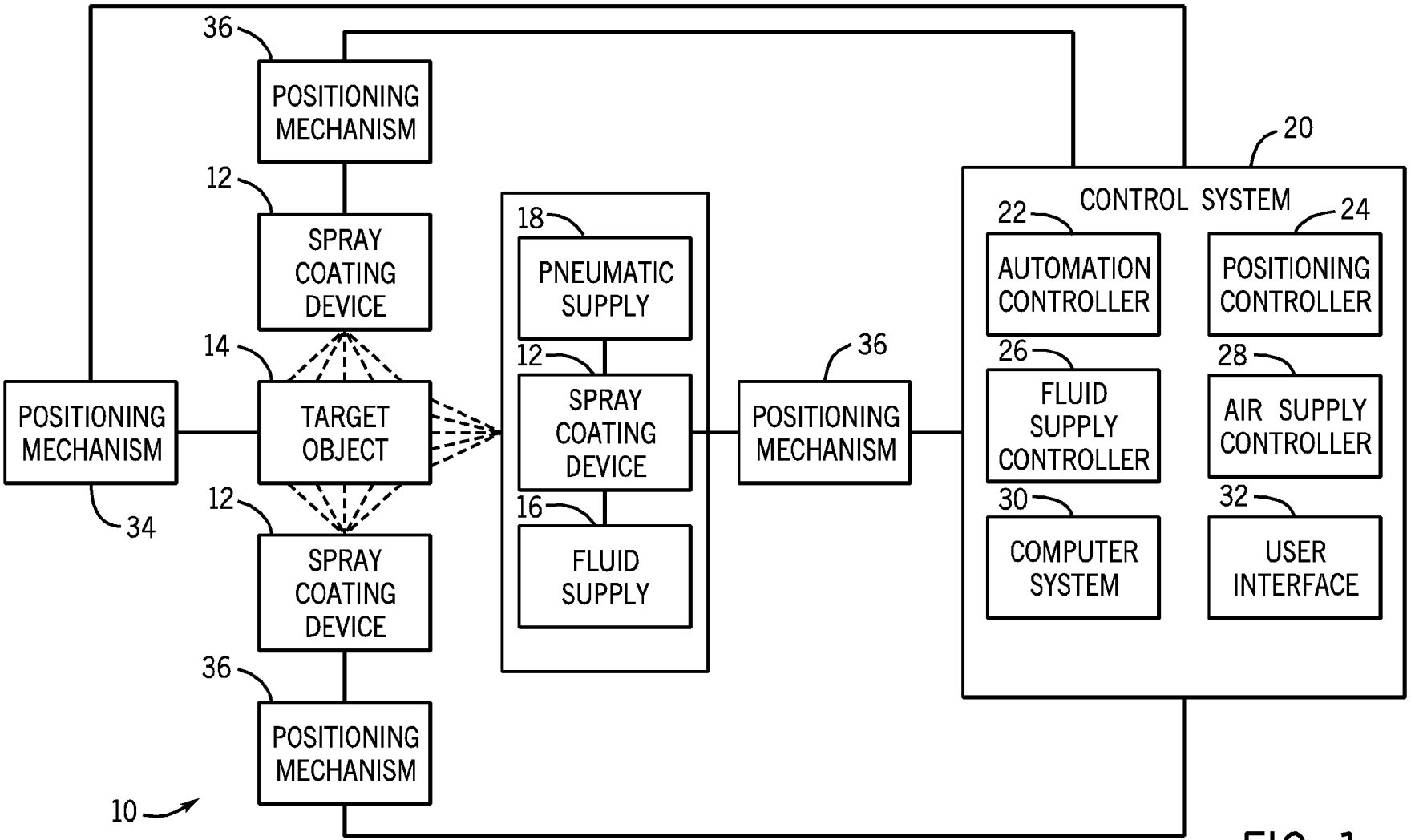
FIG. 1 is a diagram illustrating an exemplary spray coating system in accordance with certain embodiments of the present invention.

FIG. 1 is a flow chart illustrating an exemplary spray coating system 10, which comprises a spray coating device 12 for applying a desired coating to a target object 14. As discussed in detail below, the spray coating device 12 may include unique spray shaping features configured to optimize the transfer efficiency of coating fluid to the target object 14. For example, the spray shaping features may enable optimization of fluid velocity, spray coverage (e.g., area on the target object 14), uniformity of fluid distribution (e.g., uniform amount and color of fluid on the target object 14), fluid atomization, and so forth. By further example, the spray shaping features may enable a non-conical spray shape and/or a spray shape characterized by a width that varies in a non-linear manner (e.g., curved manner) from an exit of the device 12 to the target object 14. In certain embodiments, the spray shape may be characterized by a cup-shaped or concave outer profile or periphery (e.g., outer edges), such that the width and/or cross-section of the spray shape is greater than a conical shape at a distance close to the exit of the spray coating device 12. In other embodiments, the spray shape may be characterized by a tulip shaped profile or periphery. As discussed below, the unique spray shaping features may enable a greater coverage area with a suitable velocity at a distance close to the exit of the spray coating device 12, thereby improving transfer efficiency and, thus, reducing waste and pollution.

It should be noted that in the context of the present disclosure, the terms "conical" and "non-conical" when used to describe a spray shape are intended to refer to the general shape of the periphery of a cross-sectional view of the spray shape. These terms are not intended to suggest that spray particles travel only along the periphery of the spray shape. Rather, spray particles may indeed be transferred throughout the entire interior space of the spray shape.

The illustrated spray coating device 12 may comprise an air atomizer, a rotary atomizer, an electrostatic atomizer, or any other suitable spray formation mechanism. In certain embodiments, the spray coating device 12 may be described as a spray gun, which may include a gun-shape with a handle portion, a barrel or body portion coupled to the handle portion, and a trigger to engage and disengage one or more valves. However, the unique spray shaping features may be utilized on any type of spray device.

The spray coating device 12 may be coupled to a variety of supply and control systems, such as a fluid supply 16, an air supply 18, and a control system 20. The control system 20 facilitates control of the fluid and air supplies 16 and 18 and ensures that the spray coating device 12 provides an acceptable quality spray coating on the target object 14. For example, the control system 20 may include an automation controller 22, a positioning controller 24, a fluid supply controller 26, an air supply controller 28, a computer system 30, and a user interface 32.

The control system 20 also may be coupled to one or more positioning mechanisms 34 and 36. For example, the positioning mechanism 34 facilitates movement of the target object 14 relative to the spray coating device 12. The positioning mechanism 36 is coupled to the spray coating device 12, such that the spray coating device 12 can be moved relative to the target object 14. Also, the system 10 can include a plurality of the spray coating devices 12 coupled to positioning mechanisms 36, thereby providing improved coverage of the target object 14. Accordingly, the spray coating system 10 can provide a computer-controlled mixture of coating fluid, fluid and air flow rates, and spray pattern/coverage over the target object. Depending on the particular application, the positioning mechanisms 34 and 36 may include a robotic arm, conveyor belts, and other suitable positioning mechanisms.

Figure 2:
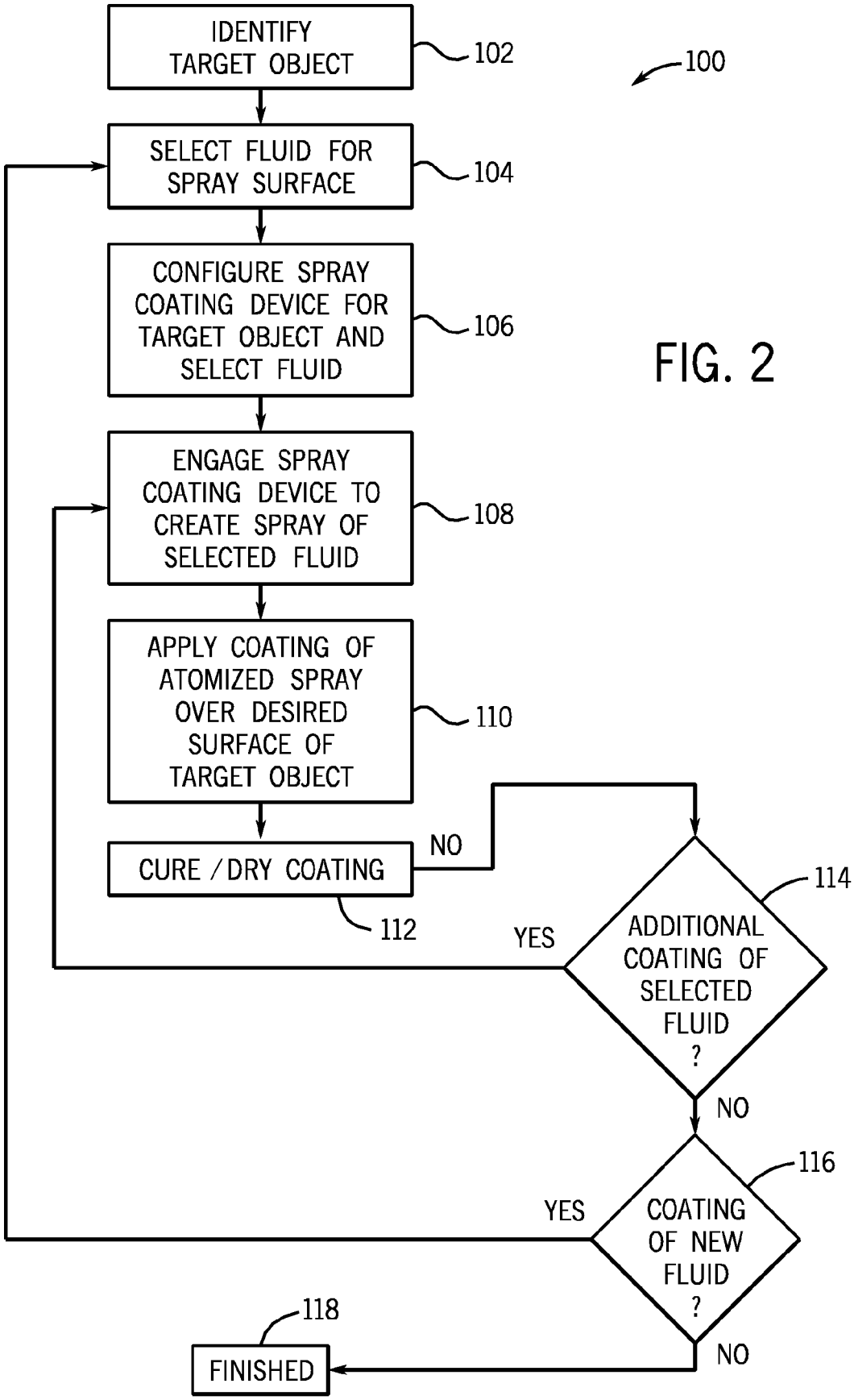
FIG. 2 is a flow chart illustrating an exemplary spray coating process in accordance with certain embodiments of the present invention.

FIG. 2 is a flow chart of an exemplary spray coating process 100 for applying a desired spray coating to the target object 14. As illustrated, the process 100 proceeds by identifying the target object 14 for application of the desired fluid (block 102). The process 100 then proceeds by selecting the desired fluid 40 for application to a spray surface of the target object 14 (block 104). The desired fluid may include a base coating fluid, a paint, a clear coat, a stain, and so forth. A user may then proceed to configure the spray coating device 12 for the identified target object 14 and selected fluid 40 (block 106). The target object 14 may include a vehicle, furniture, appliance, and so forth. As the user engages the spray coating device 12, the process 100 then proceeds to create an atomized spray of the selected fluid 40 (block 108). In certain embodiments discussed in detail below, the atomized spray has a non-conical spray shape, such as a cup-shape, a concave shape, or a tulip shape. The user may then apply a coating of the atomized spray over the desired surface of the target object 14 (block 110). The process 100 then proceeds to cure/dry (e.g., infrared curing lamp) the coating applied over the desired surface (block 112). If an additional coating of the selected fluid 40 is desired by the user at query block 114, then the process 100 proceeds through blocks 108, 110, and 112 to provide another coating of the selected fluid 40. If the user does not desire an additional coating of the selected fluid at query block 114, then the process 100 proceeds to query block 116 to determine whether a coating of a new fluid is desired by the user. If the user desires a coating of a new fluid at query block 116, then the process 100 proceeds through blocks 104-114 using a new selected fluid for the spray coating. If the user does not desire a coating of a new fluid at query block 116, then the process 100 is finished at block 118.

Figure 3:
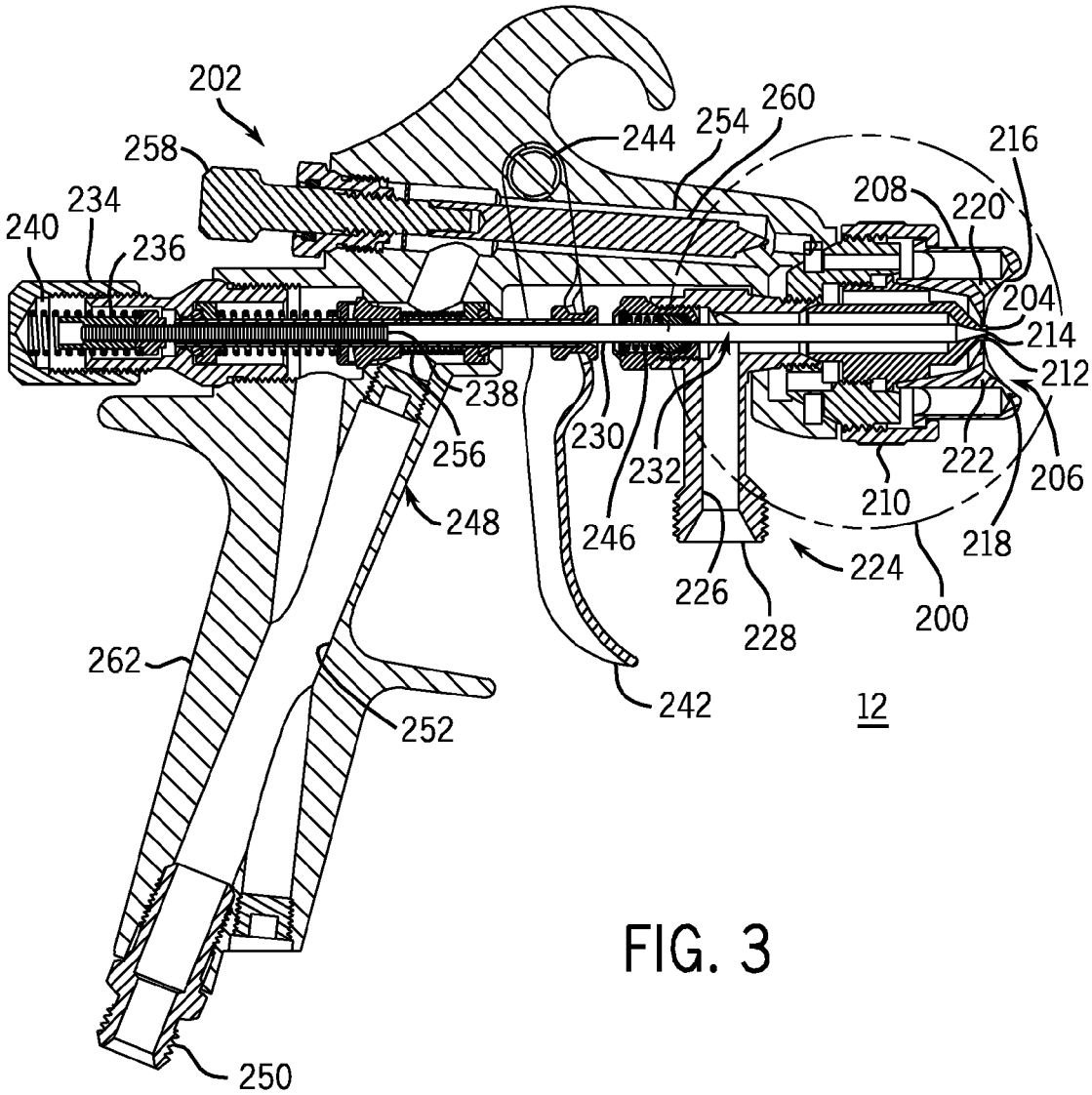
FIG. 3 is a cross-sectional side view of an exemplary spray coating device in accordance with certain embodiments of the present invention.

FIG. 3 is a cross-sectional side view illustrating an exemplary embodiment of the spray coating device 12. As illustrated, the spray coating device 12 comprises a spray tip assembly 200 coupled to a body 202. The spray tip assembly 200 includes a fluid delivery tip assembly 204. For example, a plurality of different types of spray coating devices may be configured to receive and use the fluid delivery tip assembly 204. The spray tip assembly 200 also includes a spray formation assembly 206 coupled to the fluid delivery tip assembly 204. The spray formation assembly 206 comprises an air cap 208, which is removably secured to the body 202 via a retaining nut 210. The air cap 208 includes a variety of air atomization orifices, such as a central atomization annular orifice 212 disposed about a fluid tip exit 214 from the fluid delivery tip assembly 204. The air cap 208 also may have one or more spray shaping orifices, such as spray shaping (e.g., air horn) orifices 216, 218, 220, and 222, which force the sprayed fluid to form a desired spray pattern (e.g., a non-conical pattern). The spray formation assembly 206 also may comprise a variety of other atomization mechanisms to provide a desired spray pattern and droplet distribution.

The body 202 of the spray coating device 12 includes a variety of controls and supply mechanisms for the spray tip assembly 200. As illustrated, the body 202 includes a fluid delivery assembly 224 having a fluid passage 226 extending from a fluid inlet coupling 228 to the fluid delivery tip assembly 204. The fluid delivery assembly 224 also comprises a fluid valve assembly 230 to control fluid flow through the fluid passage 226 and to the fluid delivery tip assembly 204. The illustrated fluid valve assembly 230 has a needle valve 232 extending movably through the body 202 between the fluid delivery tip assembly 204 and a fluid valve adjuster 234. The fluid valve adjuster 234 is rotatably adjustable against a spring 236 disposed between a rear section 238 of the needle valve 232 and an internal portion 240 of the fluid valve adjuster 234. The needle valve 232 is also coupled to a trigger 242, such that the needle valve 232 may be moved inwardly away from the fluid delivery tip assembly 204 as the trigger 242 is rotated counter clockwise about a pivot joint 244. However, any suitable inwardly or outwardly openable valve assembly may be used with embodiments of the present invention. The fluid valve assembly 230 also may include a variety of packing and seal assemblies, such as packing assembly 246, disposed between the needle valve 232 and the body 202.

An air supply assembly 248 is also disposed in the body 202 to facilitate atomization at the spray formation assembly 206. The illustrated air supply assembly 248 extends from an air inlet coupling 250 to the air cap 208 via air passages 252 and 254. The air supply assembly 248 also includes a variety of seal assemblies, air valve assemblies, and air valve adjusters to maintain and regulate the air pressure and flow through the spray coating device 12. For example, the illustrated air supply assembly 248 includes an air valve assembly 256 coupled to the trigger 242, such that rotation of the trigger 242 about the pivot joint 244 opens the air valve assembly 256 to allow air flow from the air passage 252 to the air passage 254. The air supply assembly 248 also includes an air valve adjustor 258 coupled to a needle 260, such that the needle 260 is movable via rotation of the air valve adjustor 258 to regulate the air flow to the air cap 208. As illustrated, the trigger 242 is coupled to both the fluid valve assembly 230 and the air valve assembly 256, such that fluid and air simultaneously flow to the spray tip assembly 200 as the trigger 242 is pulled toward a handle 262 of the body 202. Once engaged, the spray coating device 12 produces an atomized spray with a desired spray pattern (e.g., non-conical) and droplet distribution. Again, the illustrated spray coating device 12 is only an exemplary embodiment of the present invention. Any suitable type or configuration of a spraying device may benefit from the unique air cap fluid atomization and air shaping aspects of the present invention.

Figure 4:
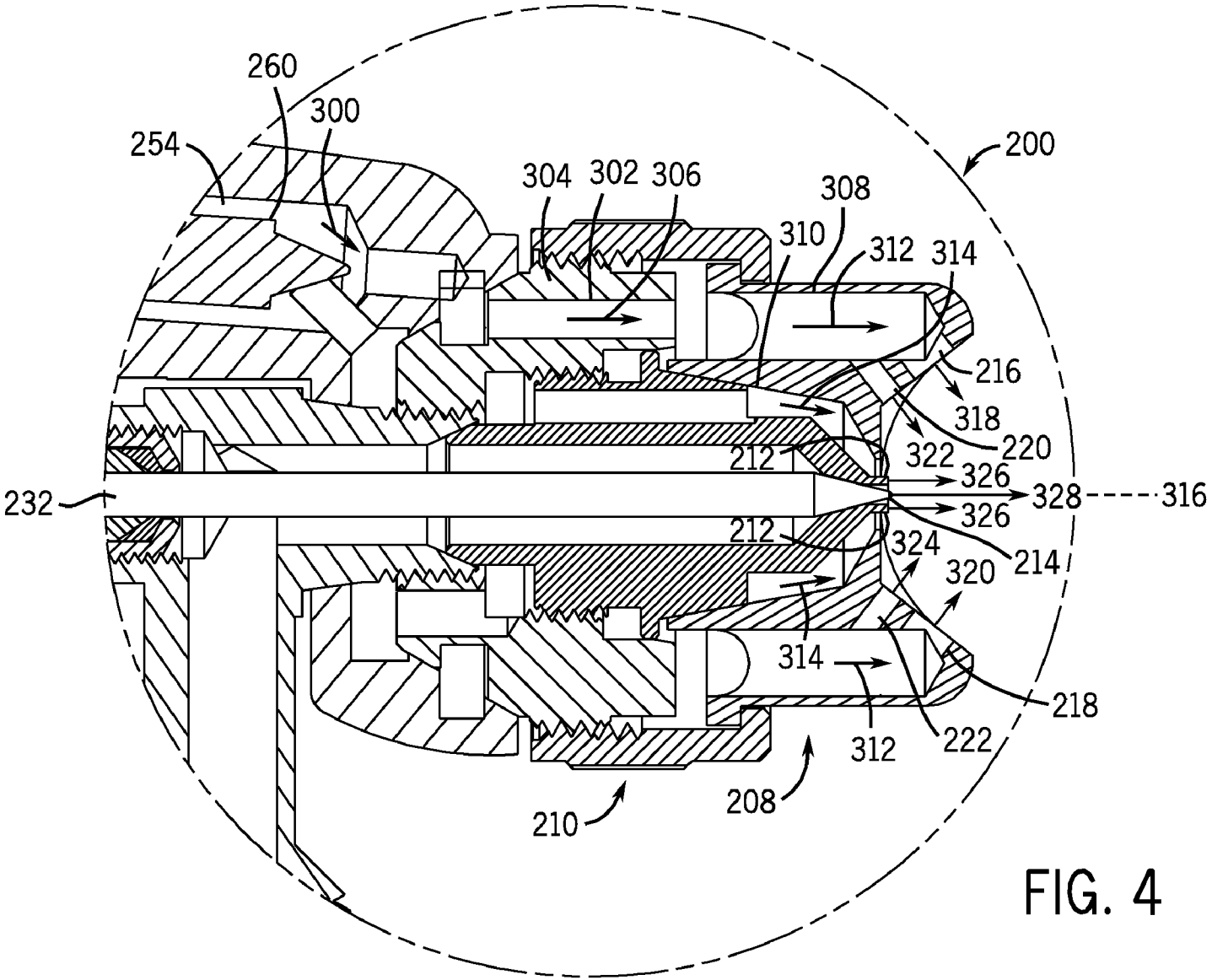
FIG. 4 is a partial cross-sectional view of an exemplary spray tip assembly of the spray coating device of FIG. 3 in accordance with certain embodiments of the present invention.

FIG. 4 is a partial cross-sectional view of the spray tip assembly 200 of the spray coating device 12 of FIG. 3 in accordance with certain embodiments of the present invention. As illustrated, the needle 260 of the air supply assembly 248 and the needle valve 232 of the fluid valve assembly 230 are both open, such that air and fluid passes through the spray tip assembly 200 as indicated by the arrows. Turning first to the air supply assembly 248, the air flows through air passage 254 about the needle 260 as indicated by arrow 300. The air then flows from the body 202 and into a central air passage 302 through a fluid nozzle 304, as indicated by arrows 306. The central air passage 302 then splits into outer and inner air passages 308 and 310 of the air cap 208, such that the air flows as indicated by arrows 312 and 314, respectively.

The outer passages 308 then connect with the shaping air horn orifices 216, 218, 220, and 222, such that air flows inwardly toward a longitudinal axis 316 of the spray tip assembly 200. These spray shaping air flows are illustrated by arrows 318, 320, 322, and 324. As illustrated, these spray shaping air flows are angled at acute angles (e.g., between 0 and 90 degrees) relative to the longitudinal axis 316. In the illustrated embodiment, the angles are between about 20-70 degrees, or 30-60 degrees, or 40-50 degrees. However, any suitable angle may be used to enable a desired non-conical shape of the forming spray.

The inner passages 310 surround the fluid delivery tip assembly 204 and extend to the central atomization annular orifice 212, which is positioned about (e.g., coaxial or concentric with) the fluid tip exit 214 of the fluid delivery tip assembly 204. This central atomization annular orifice 212 discharges atomizing air streams generally parallel to the longitudinal axis 316, as indicated by arrows 326. In the illustrated embodiment, the central atomization annular orifice 212 is configured to provide the primary force to atomize the fluid exiting the fluid tip exit 214.

In summary, these air flows 318, 320, 322, 324, and 326 are all directed toward a fluid flow 328 discharged from the fluid tip exit 214 of the fluid delivery tip assembly 204. In operation, these air flows 318, 320, 322, 324, and 326 facilitate fluid atomization to form a fluid spray and, also, shape the fluid spray into a desired pattern (e.g., non-conical). As discussed below, the air flows 318, 320, 322, 324, and 326 may be configured or oriented to shape the spray in a non-conical shape, such as a cup shape, a concave shape, or a tulip shape.

Figure 5:
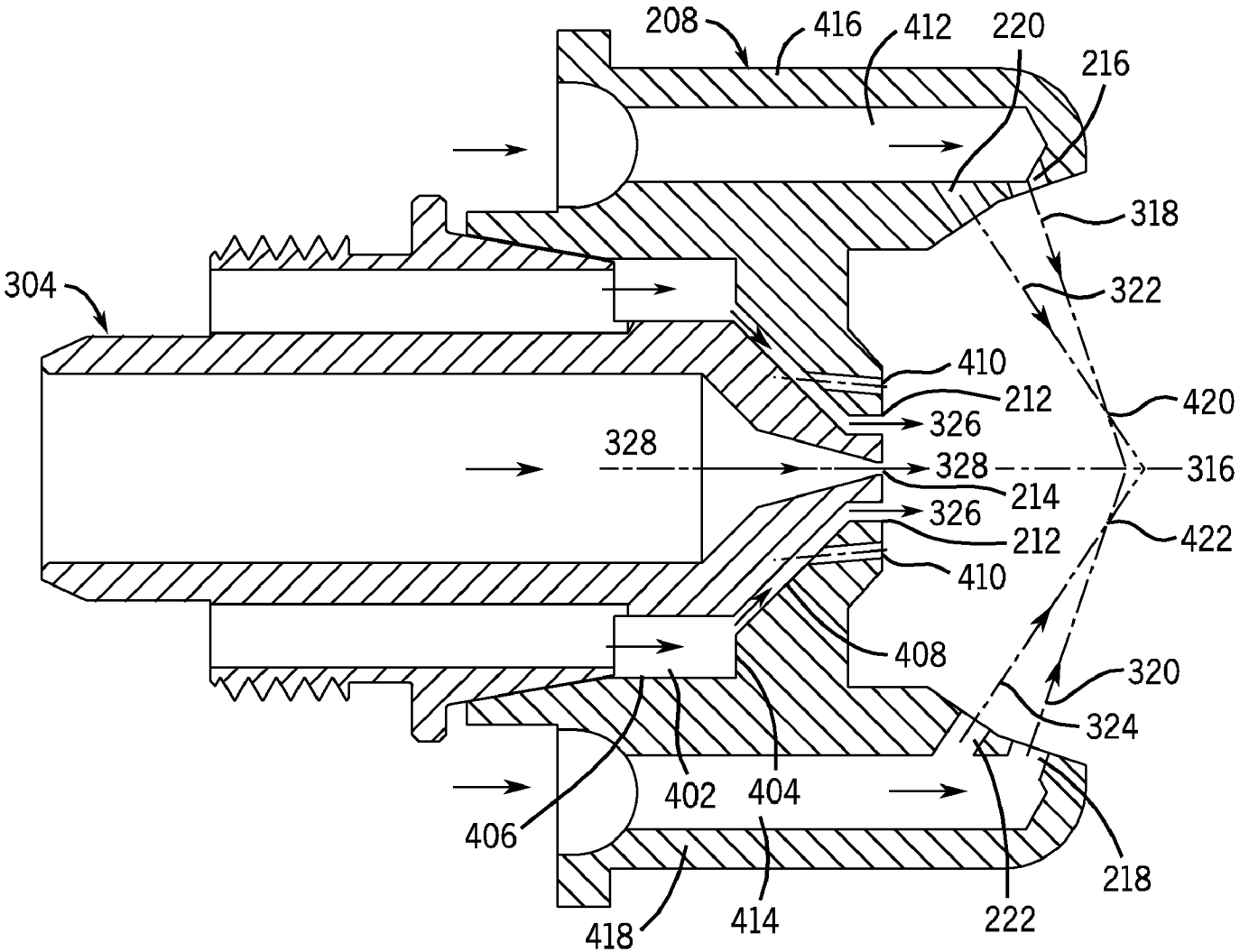
FIG. 5 is a cross-sectional view of an exemplary fluid nozzle and air cap of the spray coating device of FIG. 3 in accordance with certain embodiments of the present invention.

FIG. 5 is a cross-sectional view of an exemplary fluid nozzle 304 and air cap 208 of the spray coating device 12 of FIG. 3 in accordance with certain embodiments of the present invention. In particular, FIG. 5 illustrates interaction of the air cap 208 with the fluid nozzle 304 of the spray coating device 12 with respect to both atomization and shaping of the fluid stream. For example, as discussed above, the fluid flow 328 may be directed through the fluid nozzle 304 toward the fluid tip exit 214. The atomization air may flow through a reservoir chamber 402 formed between the fluid nozzle 304 and the air cap 208 toward the central atomization annular orifice 212 where the atomization air is discharged.

The reservoir chamber 402 (e.g., annular chamber) is formed by a lip 404 which extends generally perpendicular from an inner wall 406 of the air cap 208. This lip 404, and resulting reservoir chamber 402, naturally creates a reservoir effect upstream of the central atomization annular orifice 212, as opposed to allowing the atomization air to flow unimpeded to and through the central atomization annular orifice 212. This reservoir effect is beneficial in that the atomization air flow is allowed to stabilize by filling and pressurizing the reservoir chamber 402 before proceeding to the central atomization annular orifice 212. As such, the atomization air flow may be much more laminar by the time it reaches the central atomization annular orifice 212. This may have the effect of optimizing particle distribution. For instance, if the atomization air were allowed to continue unimpeded to the central atomization annular orifice 212, the turbulent air flow may cause more of an explosive, splattering effect on the particle distribution. However, allowing for a more laminar flow without pressure pulses and with uniform pressure distribution may generate a smoother, more controllable fluid atomization and result in more uniform distribution of fluid particles. In addition, allowing for more laminar flow of the atomization air with uniform pressure distribution helps ensure that the supply of atomization air is never depleted and there is continual back pressure behind the flow of atomization air.

The specific design of the lip 404, inner wall 406, and resulting reservoir chamber 402 may vary depending on not only the design of the air cap 208 but on the design of the fluid nozzle 304 as well. For example, the fluid nozzle 304 and the air cap 208 may be designed such that not only a reservoir chamber 402 is formed, but that the lip 404 functions as an impedance to the flow of atomization air. In addition, the fluid nozzle 304 and air cap 208 may be designed in conjunction to allow for an appropriately sized atomization channel 408 between the reservoir chamber 402 and the central atomization annular orifice 212. Furthermore, the manner in which the atomization air reaches the reservoir chamber 402 may vary depending on the particular designs of the fluid nozzle 304 and air cap 208. For instance, in the illustrated embodiment, the atomization air reaches the reservoir chamber 402 by moving through the fluid nozzle 304. However, alternative embodiments may allow for the atomization air to reach the reservoir chamber 402 by moving through a passageway created between the fluid nozzle 304 and air cap 208.

In addition, a portion of the atomization air may also be discharged through at least one pair of central air shaping orifices 410 before reaching the central atomization annular orifice 212. The shaping air flow includes multiple functions. First, this central shaping air may help prevent fluid from the fluid flow 328 from depositing on the interior face of the air cap 208. Second, this central shaping air may help direct the fluid flow toward the target object 14. In the illustrated embodiment, the central air shaping orifices 410 are aligned at a slight angle toward the longitudinal axis 316. For example, the slight angle may be less than 20 degrees, less than 15 degrees, less than 10 degrees, or less than 5 degrees relative to the longitudinal axis 316. However, in alternate embodiments, the central air shaping orifices 410 may be aligned parallel to the longitudinal axis 316.

Other shaping air streams may flow through two shaping air horn passages 412, 414 residing within two shaping air horns 416, 418 which protrude from opposite sides of the circular outer face of the air cap 208. The shaping air in the shaping air horn passages 412 and 414 exits via shaping air horn orifices 216, 220 and 218, 222, respectively, forming shaping air streams 318, 320, 322, and 324. These shaping air streams 318, 320, 322, and 324 aid in generating the desired spray pattern (e.g., non-conical) of fluid.

In the illustrated embodiment, the pairs of shaping air streams (e.g., 318, 320 and 322, 324) are generally not parallel to one another. Instead, the outer shaping air streams 318, 320 are directed toward the longitudinal axis 316 of the air cap 208 at a slightly wider angle than their respective inner shaping air stream pairs 322, 324. For example, the angle between the streams 318, 320 and the adjacent streams 322, 324 may be less than 30 degrees, less than 25 degrees, less than 20 degrees, less than 15 degrees, less than 10 degrees, or less than 5 degrees. These angles between streams is a result of angles between the axes of the outer shaping air horn orifices 216, 218 and their respective inner shaping air horn orifices 220, 222. Specifically, the orifices 216, 218 are directed toward the longitudinal axis 316 of the air cap 208 at a slightly wider angle than the respective orifices 220, 222. For example, each axis of the outer shaping air horn orifices 216, 218 may form an angle with the longitudinal axis 316 of the air cap 208 of between 60 and 75 degrees, whereas each axis of the inner shaping air horn orifices 220, 222 may form an angle with the longitudinal axis 316 of the air cap 208 of between 45 and 60 degrees. In fact, due to the specific configuration of the outer air horn orifices 216, 218 and inner air horn orifices 220, and 222, the outer shaping air streams 318, 320 actually intersect their respective inner shaping air streams 322, 324 before intersecting the fluid flow 328 along the longitudinal axis 316 of the air cap 208 (at points 420 and 422, respectively). Thus, the streams 322, 324 criss-cross, cross over one another, or generally pass in crosswise paths relative to one another.

Figures 6A, 6B:
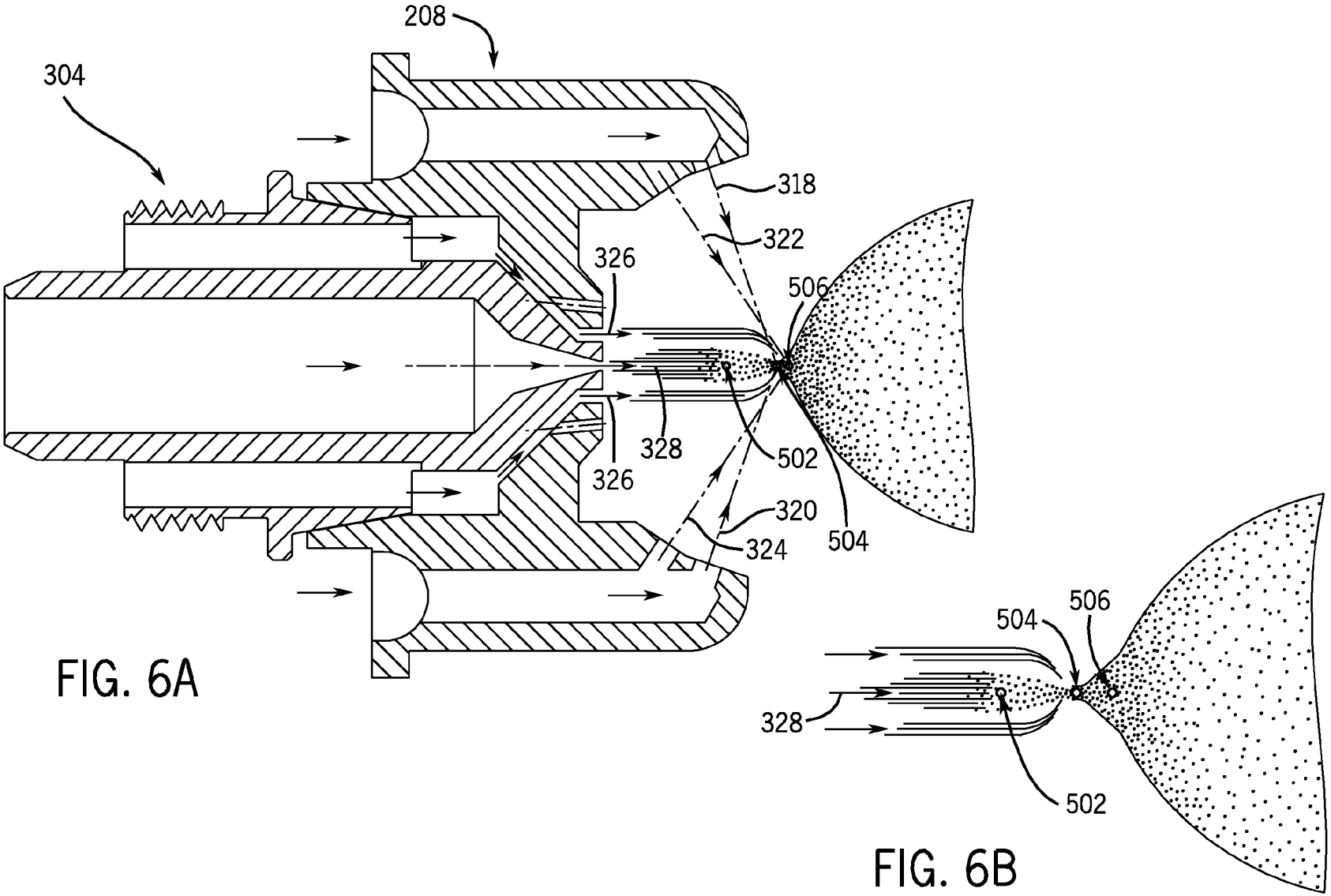
FIG. 6A is also a cross-sectional view of an exemplary fluid nozzle and air cap of the spray coating device of FIG. 3 in accordance with certain embodiments of the present invention.
FIG. 6B is a cross-sectional view of an embodiment of a spray pattern generated using certain embodiments of the present invention.

In the illustrated embodiment, the crosswise paths of the streams 318, 320 and the streams 322, 324 help generate the non-conical spray pattern, as discussed in greater detail below. FIG. 6A illustrates an exemplary embodiment of the spray tip assembly 200, illustrating the criss-crossing configuration of the shaping air streams 318, 320, 322, 324 facilitating shaping of the fluid flow 328 in a non-conical spray pattern. As the fluid flow 328 exits the fluid tip exit 214, it generally follows the path of the atomizing air streams 326, which generally form an annular shape around the fluid flow 328. The atomizing air streams 326 begin to atomize the fluid flow 328 at some point 502 before crossing the shaping air streams 318, 320, 322, 324. The atomized fluid flow 328 eventually crosses the path of the outer shaping air streams 318, 320. This point may be called a first impingement point 504. At this first impingement point 504, the atomized fluid flow 328 may begin forming a conical spray pattern and the fluid velocity of the atomized fluid flow 328 may be slightly decreased. Then, downstream of the first impingement point 504, the atomized fluid flow 328 crosses the path of the inner shaping air streams 322, 324. This point may be called a second impingement point 506. At this second impingement point 506, the fluid velocity of the atomized fluid flow 328 is further slowed and a non-conical spray pattern is formed.

FIG. 6B is a cross-sectional view of the non-conical spray pattern generated using certain embodiments of the present invention. FIG. 6B further illustrates the effects of the first and second impingement points 504, 506 on the atomized fluid flow 328. In other embodiments, more than two sets of shaping air streams may be used such that more than two impingement points are generated. Using more than two shaping air streams in this manner may lead to even greater spray pattern shaping results. For instance, a third set of shaping air steams generating a third impingement point may lead to a more stabilized spray pattern or even different spray pattern shapes, depending on the particular configuration of the shaping air orifices. In addition, in other embodiments, the shaping air orifices may be aligned such that the shaping air streams do not actually intersect each other or the fluid flow 328. Aligning the shaping air streams in this manner may lead to generally similar spray pattern shapes but may also generate swirling effects that may prove beneficial with respect to particle velocity and distribution.

Figure 7:
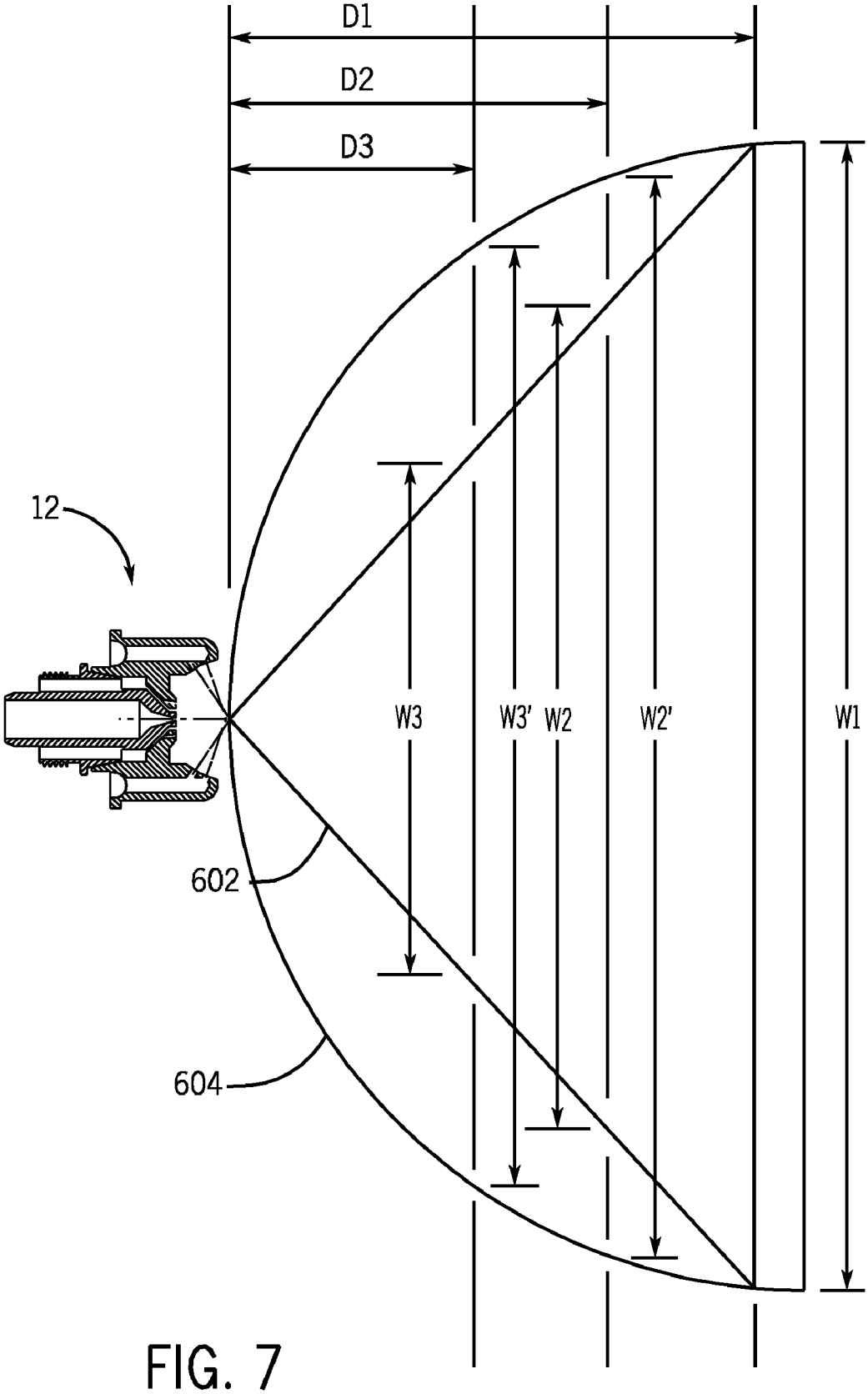
FIG. 7 is a cross-sectional view of an embodiment of a spray pattern generated using certain embodiments of the present invention.

The non-conical spray pattern may exhibit numerous advantages over the conical spray patterns typically generated by existing air caps. FIG. 7 again shows a cross-sectional view of the spray pattern generated using certain embodiments of the present invention. FIG. 7 illustrates the differences between a conical spray pattern 602 and a non-conical spray pattern 604. As illustrated in FIG. 7, the non-conical spray pattern 604 generally defines a wider approach toward a target object 14 than the conical spray pattern 602. As such, the resulting fan pattern is generally wider for the non-conical spray pattern 604 than for the conical spray pattern 602 at many of the spray distances from the target object 14 (e.g., particularly at distances close to the spray coating device 12). For instance, at some distance of $D_1$, both the non-conical spray pattern 604 and the conical spray pattern 602 will generate fan patterns having the same width of $W_1$. However, as the spray coating device 12 is moved closer to the target object 14, the fan pattern resulting from the non-conical spray pattern 604 becomes progressively wider than the fan pattern resulting from the conical spray pattern 602. For instance, at some distance $D_2$ which is closer than distance $D_1$, the resulting width $W_2$ of the fan pattern generated by the non-conical spray pattern 604 is greater than the resulting width $W_2$ of the fan pattern generated by the conical spray pattern 602. This trend will continue until some distance, illustrated in FIG. 7 as $D_3$, where the resulting fan pattern generated by the non-conical spray pattern 604 will gradually begin getting closer to that of the fan pattern generated by the conical spray pattern 602.

Therefore, the non-conical spray pattern 604 may generally lead to more consistent fan pattern widths regardless of the distance of the spray coating device 12 from the target object 14. For example, the conical spray pattern 602 may generally require a distance of 8-10 inches between the spray coating device 12 and the target object 14 in order to maintain a consistent fan pattern width. In contrast, the non-conical spray patterns 604 may reduce variations in the fan pattern width over a greater range of distances between the spray coating device 12 and the target object 14, thereby enabling a more consistent fan pattern despite the distance. Furthermore, the non-conical spray pattern 604 may enable positioning at much closer or farther distances between the spray coating device 12 and the target object 14, thereby enabling better optimization of both the fluid velocity and the fan pattern width. For example, the spray coating device 12 may be positioned at 5-6 inches or 12-14 inches rather than 8-10 inches from the target object 14, thereby improving the transfer efficiency due to a more appropriate fluid velocity along with a suitably large fan pattern width. These distances are merely illustrative but they do show some advantages to the non-conical spray pattern 604 versus the conical spray pattern 602. For instance, as mentioned above, resulting fan pattern widths may generally be more consistent with the non-conical spray pattern 604. In addition, there may not be as great of a need to hold the spray coating device 12 at a certain distance from the target object 14 to generate a consistent fan pattern with the non-conical spray pattern 604.

Furthermore, due to the dual air stream impingement, the fluid velocity of the atomized fluid flow 328 is substantially reduced. Subsequently, when the slower velocity atomized fluid/air fan pattern is deposited onto a sprayed target object 14, a reflective force of the fan pattern from the target object 14 is minimized, causing most of the fluid particles to be deposited onto the surface of the target object 14. In other words, as a result of the reduced fluid velocity, a greater amount of the fluid is transferred to the target object 14 (e.g., increased transfer efficiency). Existing spray coating devices (with conical spray patterns) have poor transfer efficiency at distances closer to the spray tip exit, because the fluid velocity is too high and the spray pattern width is too small. In contrast, the disclosed embodiments both decrease the fluid velocity and increase the spray pattern width (or general coverage area) at closer distances to the spray tip exit. As a result, the spray coating device 12 can be positioned over a larger range of distances relative to the target object 14, thereby enabling optimization of the fluid velocity while maintaining a suitably wide spray pattern. In addition, the disclosed embodiments allow for a more uniform distribution along the entire fan pattern. This is partially due to the fact that the fluid velocity is substantially reduced toward the periphery of the spray pattern. However, it is also partially due to the fact that the spray particles in non-conical spray patterns may approach the target objects 14 at substantially perpendicular angles as opposed to the angled approach typical in conical spray patterns.

Figure 8:
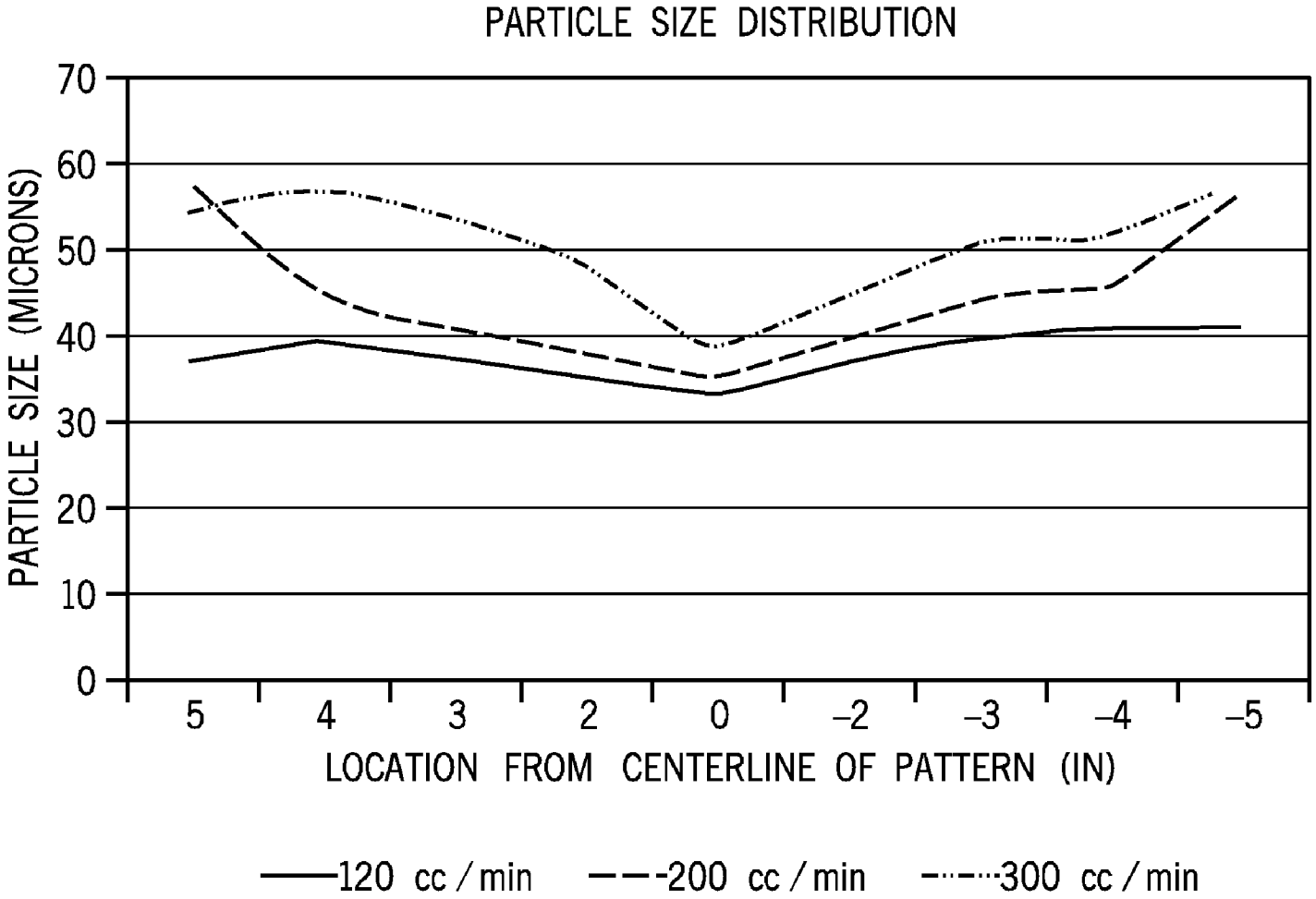
FIG. 8 is a graph illustrating exemplary particle size distribution of a spray coating device in accordance with certain embodiments of the present invention.

Preliminary test results have proven that embodiments of the present invention may provide numerous benefits over other existing air caps. For example, as illustrated by FIG. 8, one particular test showed that the particle size distribution over a particular pattern width was substantially uniform at various flow rates. Particle size is typically expressed in various methods found in ASTM standard E1620-97. For testing purposes, D32 Sauter Mean Diameter or SMD32 was used. The Sauter Mean Diameter (SMD) is defined as the diameter of a sphere that has the same volume/surface area ratio as a particle of interest. The SMD is a common measure in fluid dynamics as a way estimating average particle size. Calculation is usually taken as the mean of several measurements or samples. The measurement of particles in the testing was performed via flux distribution techniques using a Malvern particle size analyzer. Flux measurement is recorded by optical instrumentation that is capable of measuring individual drop sizes.

In a typical spray gun of the prior art, the fluid stream begins to form atomized droplets at a distance of 5-10 mm from the fluid nozzle tip. At this point, the velocity of combined air and fluid stream is extremely high. These velocities are very impractical in spray applications and must be substantially decreased to much lower velocities to be usable for spray finishing applications. Typical atomized patterns of the prior art, when formed with shaping air jets, continue at these very high velocities in a range of 10-30 meters/second at 8 inches from the fluid nozzle. These higher spray velocities may cause paint overspray, lower paint transfer efficiencies, and subsequent waste of costly paint.

A certain balance of collinear air flow velocity and air pressure around the fluid stream plays a key role as to how big or small the particle sizes become using the techniques of the disclosed embodiments. In addition, the particle distribution uniformity within the shape of the fan pattern is significantly influenced by precise positioning of shaping air impingement points into the atomized fluid stream. A substantial velocity reduction down to 5 meters/second and a wide pattern up to 12 inches was achieved during testing with the precise positioning of shaping air horn jets as described in detail above. In addition, the tulip-shaped pattern was formed with very uniform pattern particle distribution.

Particle size and particle distribution within the spray pattern is an important factor in overall performance of the fluid nozzle and air cap combination of the disclosed embodiments. Specifically, spray particle distribution uniformity plays an important role in achieving adequate paint distribution on the substrate of the target object and subsequently good finish quality. An added benefit of the lower velocity spray fan pattern may be minimum "overspray" bounce back from the substrate being coated.

In contrast to the results of the testing, most prior art high-velocity, low pressure (HVLP) air caps exhibit larger particle concentration on the edges of the fan pattern. In addition, the maximum fan pattern size generated by the disclosed embodiments has been shown to be considerably larger (e.g., up to 15 inches or more) than those generated by other air caps. Also, as mentioned above, the lower velocities generated by the disclosed embodiments generally allow for minimum bounce back of fluid particles. For example, the disclosed embodiments have been shown to produce acceptable atomization quality using air velocities as low as 5 meters/second, as opposed to typical HVLP air caps which can sometimes require air velocities of 12-18 meters/second. This, of course, also indirectly leads to lower overall fluid and air consumption.

Therefore, the disclosed embodiments provide low air consumption, low air velocities, and consistently uniform spray patterns, which, in turn, lead to uniform spray quality and less waste. As mentioned above, unlike typical air caps, the disclosed embodiments generate a non-conical spray pattern allowing the spray coating device 12 to achieve larger fan pattern size when spraying close to the surface. A unique characteristic of the disclosed embodiments is that it is able to atomize spray coatings at HVLP application levels, which range from 0 to 10 psi air at the air cap, but it can also atomize spray coatings successfully at low volume, medium pressure (LVMP) levels between 10 and 30 psi levels.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A spray coating device, comprising:

a liquid passage;

an air passage;

one or more valves configured to open and close flow of liquid through the liquid passage and air through the air passage;

a trigger coupled to the one or more valves; and a spray head configured to generate a non-conical liquid spray, wherein the spray head comprises:

a liquid exit in fluid communication with the liquid passage, wherein the liquid exit has a longitudinal axis of liquid flow;

an air exit in fluid communication with the air passage, wherein the air exit is coaxial with the liquid exit;

a first plurality of air shaping orifices formed in opposite air horns and in fluid communication with the air passage, wherein the first plurality of air shaping orifices have first axes that generally converge toward a first point along the longitudinal axis at first acute angles relative to the longitudinal axis; and a second plurality of air shaping orifices formed in opposite air horns and in fluid communication with the air passage, wherein the second plurality of air shaping orifices have second axes that generally converge toward a second point along the longitudinal axis at second acute angles relative to the longitudinal axis, the first and second acute angles are different from one another, the first and second axes are crosswise to one another between the longitudinal axis and the first and second plurality of air shaping orifices, and the first and second points are in series one after another along the longitudinal axis in an opposite order relative to the first and second plurality of air shaping orifices, wherein the first and second pluralities of air shaping orifices are configured to output non-hollow air shaping streams.

2. The spray coating device of claim 1, comprising a one-piece air cap having the air exit, the first plurality of air shaping orifices, and the second plurality of air shaping orifices.

3. The spray coating device of claim 1, wherein each orifice of the first and second pluralities of air shaping orifices is open across its centerline.

4. A spray shaping system, comprising:

a first plurality of air shaping orifices formed in opposite air horns and having first axes directed toward a longitudinal axis of a liquid stream at first acute angles relative to the longitudinal axis; and a second plurality of air shaping orifices formed in opposite air horns and having second axes directed toward the longitudinal axis of the liquid stream at second acute angles relative to the longitudinal axis, wherein the first and second axes cross one another prior to reaching the longitudinal axis, and the first and second acute angles are different from one another, wherein the first and second pluralities of air shaping orifices are configured to output non-hollow air shaping streams.

5. The spray shaping system of claim 4, wherein the first and second pluralities of air shaping orifices are configured to shape the liquid stream into a non-conical spray shape.

6. The spray shaping system of claim 5, wherein the non-conical spray shape comprises a cup shaped spray, a concave spray, or a tulip shaped spray.

7. The spray shaping system of claim 5, wherein the first plurality of air shaping orifices is configured to generate a conical spray shape, and the second plurality of air shaping orifices is configured to generate the non-conical spray shape.

8. The spray shaping system of claim 4, wherein the first plurality of air shaping orifices is axially offset from the second plurality of air shaping orifices in an upstream direction relative to the longitudinal axis, the first axis crosses the longitudinal axis at a first axial position, the second axis crosses the longitudinal axis at a second axial position, and the first axial position is axially offset from the second axial position in a downstream direction relative to the longitudinal axis.

9. The spray shaping system of claim 4, wherein the first and second acute angles are different from one another.

10. The spray shaping system of claim 9, wherein the first and second acute angles are between about 10 to 80 degrees, and the first and second acute angles differ from one another by less than 45 degrees.

11. The spray shaping system of claim 9, wherein the first and second acute angles differ from one another by less than 30 degrees.

12. The spray shaping system of claim 4, wherein each orifice of the first and second pluralities of air shaping orifices is open across its centerline.

13. A spray coating system, comprising:

an air cap, comprising:

a central atomization orifice having a longitudinal axis;

a first set of air shaping orifices disposed on air horns on opposite sides of the central atomization orifice, wherein the first set of air shaping orifices are directed toward a first point along the longitudinal axis; and a second set of air shaping orifices disposed on air horns on opposite sides of the central atomization orifice, wherein the second set of air shaping orifices are directed toward a second point along the longitudinal axis, the first set of air shaping orifices is axially upstream from the second set of air shaping orifices relative to the longitudinal axis, and the first point is axially downstream from the second point along the longitudinal axis, wherein the first and second sets of air shaping orifices are configured to output non-hollow air shaping streams.

14. The spray coating system of claim 13, wherein the first set of air shaping orifices have first axes that are oriented at first angles of between 45 and 60 degrees relative to the longitudinal axis, and the second set of air shaping orifices have second axes that are oriented at second angles of between 60 and 75 degrees relative to the longitudinal axis.

15. The spray coating system of claim 13, wherein the air cap comprises a set of central air shaping orifices disposed about the central atomization orifice at radii less than the first and second sets of air shaping orifices.

16. The spray coating system of claim 13, comprising a fluid nozzle coupled to the air cap, wherein the fluid nozzle and the air cap define a reservoir chamber having a wall transverse to the longitudinal axis.

17. The spray coating system of claim 13, wherein the air cap is a one-piece air cap having the central atomization orifice, the first set of air shaping orifices, and the second set of air shaping orifices.

18. The spray coating system of claim 13, wherein each orifice of the first and second sets of air shaping orifices is open across its centerline.

19. A spray coating device, comprising:

a body comprising liquid and air passages; and a fluid delivery tip assembly coupled to the body, comprising:

a liquid orifice configured to output a liquid stream;

an air orifice configured to output a first air stream toward the liquid stream to generate an atomized liquid spray; and a plurality of air shaping orifices formed in opposite air horns and configured to output non-hollow air shaping streams toward the atomized liquid spray to shape the atomized liquid spray into a cup shape, wherein the plurality of air shaping orifices comprise a first air shaping orifice axially upstream from a second air shaping orifice relative to a longitudinal axis of the fluid delivery tip assembly, the first air shaping orifice has a first axis directed toward a first position along the longitudinal axis, the second air shaping orifice has a second axis directed toward a second position along the longitudinal axis, and the first position is axially downstream from the second position along the longitudinal axis.

20. The spray coating device of claim 19, wherein the first and second axes are crosswise to one another between the longitudinal axis and the first and second air shaping orifices.

21. The spray coating device of claim 19, wherein each orifice of the plurality of air shaping orifices is open across its centerline.

22. A system, comprising:

a spray shaping component of a spray device, wherein the spray shaping component comprises:

a liquid orifice having a liquid ejection axis;

a first air shaping orifice formed in an air horn and having a first axis crosswise to the liquid ejection axis, wherein the first axis is directed toward a first region along the liquid ejection axis; and a second air shaping orifice formed in the air horn and having a second axis crosswise to the liquid ejection axis, wherein the second axis is directed toward a second region along the liquid ejection axis, the first region is axially downstream from the second region along the liquid ejection axis, and the first air shaping orifice is axially upstream from the second air shaping orifice relative to the liquid ejection orifice, wherein the first and second air shaping orifices are configured to output non-hollow air shaping streams.

23. The system of claim 22, wherein the first and second axes are crosswise to one another between the liquid ejection axis and the first and second air shaping orifices.

24. The system of claim 22, comprising a plurality of first air shaping orifices axially upstream from a plurality of second air shaping orifices.

25. The system of claim 22, comprising a spray head having the spray shaping component.

26. The system of claim 22, comprising a spray gun having the spray shaping component.

27. The system of claim 22, wherein each orifice of the first and second air shaping orifices is open across its centerline.

* * * * *